US011162485B2

(12) United States Patent
Junior et al.

(10) Patent No.: US 11,162,485 B2
(45) Date of Patent: Nov. 2, 2021

(54) CYLINDER COVER FOR ALTERNATIVE COMPRESSOR

(71) Applicant: EMBRACO INDUSTRIA DE COMPRESSORES E SOLUCOES EM REFRIGERACAO LTDA., Joinville (BR)

(72) Inventors: Raul Bosco Junior, Joinville (BR); Moacir Pirovano, Joinville (BR); Tadeu Tonheiro Rodrigues, Joinville (BR)

(73) Assignee: EMBRACO—INDÚSTRIA DE COMPRESSORES E SOLUÇÕES EM REFRIGERAÇÃO LTDA., Joinville (BR)

( * ) Notice: Subject to any disclaimer, the term of this patent is extended or adjusted under 35 U.S.C. 154(b) by 0 days.

(21) Appl. No.: 14/366,967

(22) PCT Filed: Nov. 8, 2012

(86) PCT No.: PCT/BR2012/000436
§ 371 (c)(1),
(2) Date: Jun. 19, 2014

(87) PCT Pub. No.: WO2013/091047
PCT Pub. Date: Jun. 27, 2013

(65) Prior Publication Data

US 2014/0363322 A1 Dec. 11, 2014

(30) Foreign Application Priority Data

Dec. 20, 2011 (BR) ..... PI1105384-4

(51) Int. Cl.
*F04B 39/12* (2006.01)
*F04B 53/10* (2006.01)

(52) U.S. Cl.
CPC ..... *F04B 39/12* (2013.01); *F04B 39/125* (2013.01); *F04B 53/1085* (2013.01)

(58) Field of Classification Search
CPC .... F04B 39/12; F04B 39/125; F04B 39/1073; F04B 53/1085; Y10T 137/7892; Y10T 29/49236; F16K 27/00
(Continued)

(56) References Cited

U.S. PATENT DOCUMENTS 3,509,907 A * 5/1970 Gannaway ..... F04B 39/102 137/493.8
3,807,910 A * 4/1974 Paget ..... F04B 39/1086 417/564
(Continued)

FOREIGN PATENT DOCUMENTS

CN 201635961 U * 11/2010
DE 2617079 A1 * 11/1977 ..... F04B 39/064
(Continued)

OTHER PUBLICATIONS

International Search Report issued in International Application No. PCT/BR2012/000436 dated Feb. 7, 2013.

*Primary Examiner* — Nathan C Zollinger
(74) *Attorney, Agent, or Firm* — Foley & Lardner LLP

(57) ABSTRACT

A cylinder cover comprises a block (1) provided with at least a sealing contour (11) and at least a support projection (3) for supporting a discharge valve stop. The support projection (3) is spaced from the sealing contour (11) through at least one gap (4).

3 Claims, 5 Drawing Sheets

(58) Field of Classification Search
USPC ..... 417/437, 423.14, 569
See application file for complete search history.

(56) References Cited

U.S. PATENT DOCUMENTS

| | | | | | |
|---|---|---|---|---|---|
| 4,717,313 | A * | 1/1988 | Ohno | F04B 27/0826 | 417/269 |
| 5,249,939 | A * | 10/1993 | Takahashi | F04B 39/108 | 417/566 |
| 5,466,129 | A * | 11/1995 | Fukai | F04B 39/1073 | 137/512.4 |
| 5,779,459 | A | 7/1998 | Park et al. | | |
| 5,909,749 | A * | 6/1999 | Lee | F04B 39/1073 | 137/856 |
| 6,454,545 | B1 * | 9/2002 | Ikeda | F04B 27/1009 | 137/856 |
| 7,607,900 | B2 * | 10/2009 | Ichikawa | F04B 27/1081 | 417/269 |
| 2008/0159881 | A1 | 7/2008 | Bosco et al. | | |
| 2011/0200471 | A1 * | 8/2011 | Kato | F01C 21/10 | 417/437 |

FOREIGN PATENT DOCUMENTS

| | | | | |
|---|---|---|---|---|
| EP | 1740832 | B1 | 1/2007 | |
| GB | 2243194 | A | 10/1991 | |
| WO | WO-2007037239 | A1 * | 4/2007 | F04B 39/1073 |
| WO | WO-2018007313 | A1 * | 1/2018 | |

* cited by examiner

CYLINDER COVER FOR ALTERNATIVE COMPRESSOR

RELATED APPLICATIONS

The subject application is a U.S. National Stage Application of International Application No. PCT/BR2012/000436, filed on Nov. 8, 2012, which claims the priority of Brazil Patent Application No.: PI1105384-4, filed on Dec. 20, 2011, the contents of which are herein incorporated by reference in its entirety.

FIELD OF THE INVENTION

The present invention refers to a cylinder cover for alternative compressor and, more specifically, a cylinder cover comprising support and holding means for an exhaustion valve stopper present in an alternative compressor head assembly.

BACKGROUND OF THE INVENTION

It is of general knowledge that compressors, including alternative compressors, are machines responsible for increasing any (general gaseous) working fluid pressure.

In this regard, and in a more specific way, alternative compressors are capable of increasing pressure of a working fluid by controlled alteration of a compression chamber volume, wherein such controlled alteration of volume is carried out by a piston capable of alternative displacement inside the compression chamber.

Intrinsic functioning of an alternative compressor thus comprises two functional steps, that is, suction step and exhaustion step.

Suction step occurs when a piston retreats (within a compression chamber), promoting suction of working fluid through a suction inlet at low pressure. Exhaustion step occurs when the piston advances (into the compression chamber), promoting exhaustion of working fluid through an exhaustion outlet at high pressure.

Therefore, those skilled in the art are well acquainted with the fact that the correct functioning of an alternative compressor also depends on the sealing of the exhaustion outlet during suction steps and on the sealing of the suction inlet during exhaustion steps. Hence, alternative compressors further comprise suction and exhaustion valves capable of effecting sealing at correct times. In this regard, the present state of the art comprises a large number suction and exhaustion valve models and arrangements (and the like).

Conventionally, said valve are assembled just near a compression chamber, or also just near, suction, and exhaustion chambers (subdivisions of a compression chamber), respectively. More specifically, it is further observed that such valves are mounted to be disposed between and/or resting between the compression chamber and cylinder cover.

FIGS. 1A and 1B illustrate a conventional embodiment (that is, pertaining to the state of the art) of a cylinder cover specifically suitable for securing/alignment of an exhaustion value (EV) and its respective stopper support (SS). Generally speaking, a cylinder cover shown in FIG. 1 comprises a Block BL1 constituted by the joint contour JC1 and comprises two stopper supports SS11.

Said joint contour JC1 is responsible for integrally sealing a compressor cavity (region between the cylinder cover and the compressor shell (not shown)) and the compression chamber, and the assembly thereof may further comprise sealing members (not shown).

Stopper supports SS11 comprising extensions formed from the portions of the joint contour JC1 and define support areas for the edges of a stopper S, and, especially, for a stopper S having a substantially square perimeter.

A head cover depicted in FIGS. 1A and 1B is a relatively obsolete embodiment since same only defines two stopper supports for a discharge valve stopper, thereby allowing for the mediated region of a stopper to remain with no support, wherein this characteristic may cause problems for the functioning of the discharge valve.

FIG. 1C shows an optimization in a cylinder cover illustrated in FIGS. 1A and 1B.

In this embodiment, block BL1 further provides, in addition to two stopper supports SS11, a third stopper support SS12, which is projected from the bottom of said block BL1 (in a virtual geometric axis "Y"), and from a third point of the joint contour JC1 (in a second virtual geometrical axis "X"). Although this embodiment solves a great part of problems presently found in the cylinder cover shown in FIGS. 1A and 1B, it can be noted that these embodiments are only intended for stoppers of discharge valves (having a substantially square perimeter).

It also worth mentioning that the present state of the art comprises a number of cylinder covers for alternative compressors whose embodiments are also intended only for stoppers.

Another example of these configurations is described in U.S. Pat. No. 5,779,459, which mentions (among other aspects) different solutions for assembly between a discharge valve (and its stopper) and the joint contour of the cylinder cover block. Hence, embodiments of stoppers are disclosed therein.

FIG. 1D illustrates another embodiment of the state of the art. However, such embodiment is partially different from the formerly approached embodiment in that it provides a stopper housing for an exhaustion valve (which can be V-shaped, W-shaped, or E-shaped as well).

By this way, said cylinder cover shown in FIG. 1D comprises block BL2 also constituted by a joint contour JC2, two supports SS21 and one support SS22.

Said support SS21 comprises extensions formed from the portions of the joint contour JC2, and defined support areas for "distal" edges of a stopper.

With regard to the support SS22, it refers to a massive and structural extension existing from a certain point on the joint contour JC2.

From this embodiment of cylinder cover as well as in all other embodiments known and intended for the housing of a stopper of an exhaustion valve including a support point defined in a massive and structural extension existing from a determined point on the joint contour, it can be observed that there is a drawback relative to the integrity of the sealing between the cylinder cover and the head/compression chamber of alternative compressors.

This drawback is mainly related to physical deformation (even if millimetric) caused by pressures of the support exerted on support SS22 by the exhaustion valve stopper. Such physical deformations are conventionally exerted on at least a portion of the joint contour JC2, and this interferes negatively on the integrity of sealing existing between the cylinder cover and the head/compression chamber of alternative compressors; after all, these physical deformations end up creating escaping points of working fluid, which is unacceptable and/or undesirable in most of alternative compressors.

Based on this scenario, the present patent of invention was developed.

OBJECT OF THE INVENTION

By this way, an object of the present invention is to provide a cylinder cover capable of ensuring the integrity of its seating with head/chamber of an alternative compressor.

Therefore, another object of the present invention is to define support points/housing for exhaustion valve stoppers.

In this regard, a further object of the invention is that said support points/housing possesses substantially resilient characteristics.

SUMMARY OF THE INVENTION

These objects and others concerning the presently disclosed invention are fully achieved by means of a cylinder cover for alternative compressor, which comprises a block provided with at least a joint contour and at least a support extension projected from a portion of at least a joint contour. Said cylinder cover for alternative compressor, as presently disclosed, further comprises at least a support projection spaced from the sealing contour through at least one gap.

Preferably, said cylinder cover for alternative compressor provides two support projections spaced from the sealing contour through one gap and are spaced from each other through at least another gap.

In accordance with the present invention, and in a preferred mode, at least one support projection is parallel to at least a portion of at least a sealing contour.

Further, it is observed that support projections possess mechanical resilience, wherein even during their maximum mechanical deformation, they remain spaced from the sealing contour through at least one gap.

BRIEF DESCRIPTION OF THE FIGURES

The embodiments of the objects of the present invention will be described in detail based on figures listed below, wherein.

DETAILED DESCRIPTION OF THE INVENTION

Figure 1A:
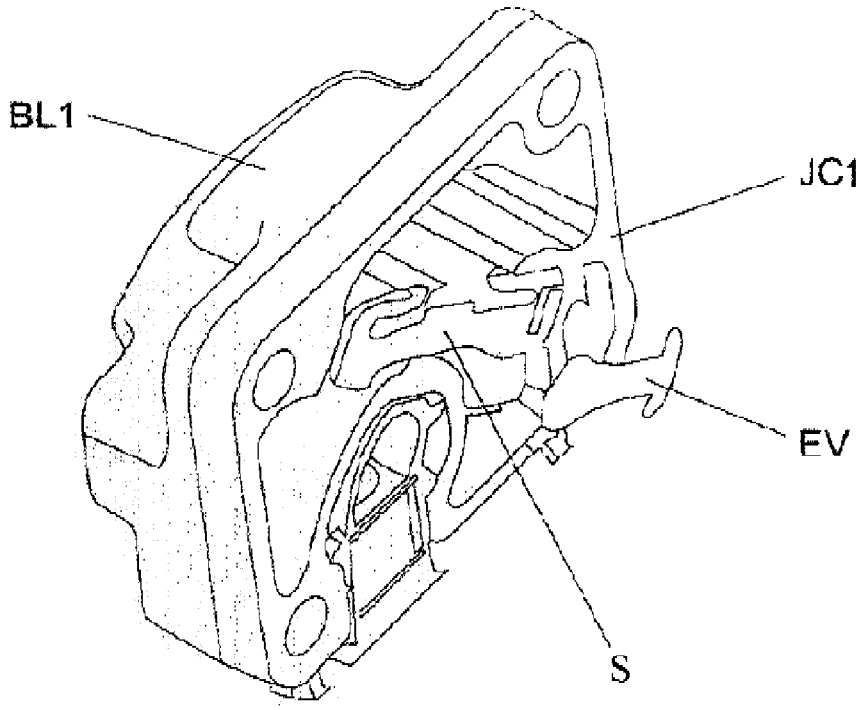
FIG. 1A PRIOR ART
FIGS. 1A, 1B, 1C and 1D depict cylinder covers pertaining to the present state of the art.
Figure 1B:
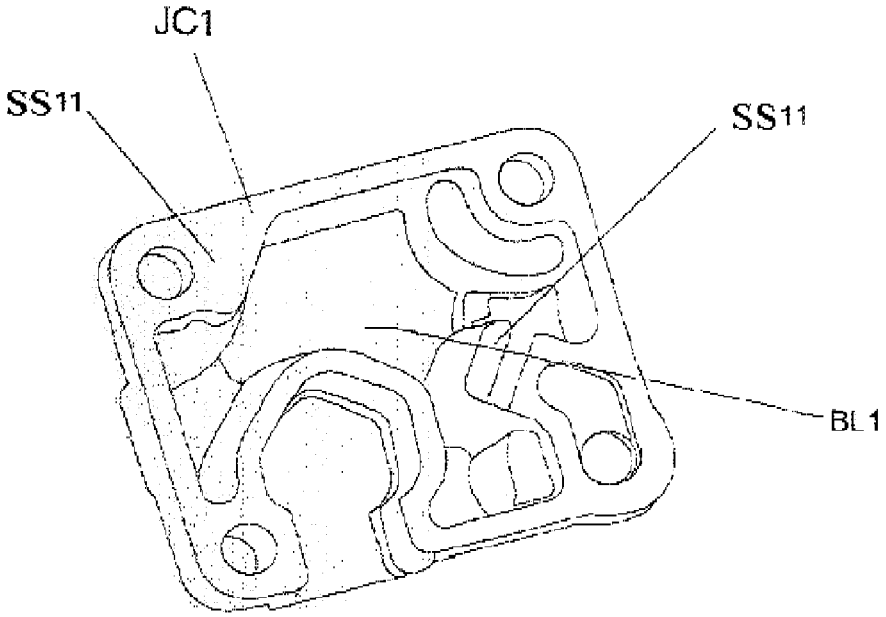
FIG. 1B PRIOR ART
Figure 1C:
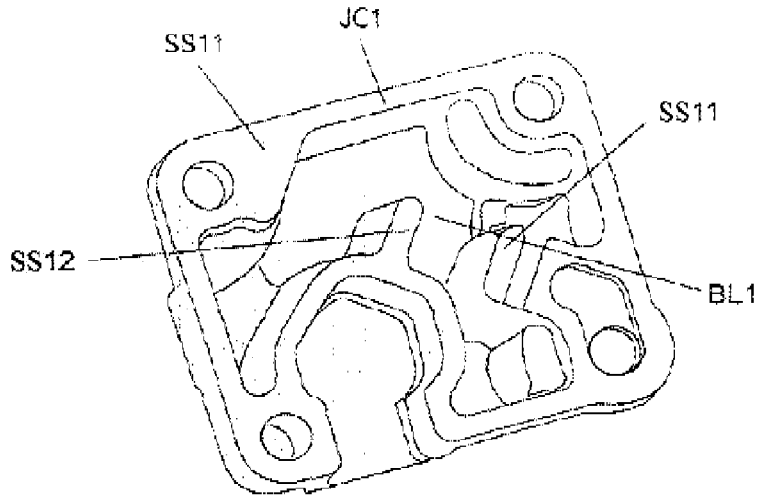
FIG. 1C PRIOR ART

According to the concepts and objects of the present invention, it is disclosed a cylinder cover whose regions of support/housing for a discharge valve stopper are capable of discrete and elastic mechanical deformation, where such deformation will never be extended (or at least strongly reduced) to the sealing regions between the compressor cavity and the exhaustion chamber of alternative compressor.

This will allow for said regions to maintain the sealing integrity between the compressor and the head/compression chamber of alternative compressor.

Essentially, said projections have the ability to absorb deformation exerted by the pressure of valve stopper assemblage such that deformations are not transferred to the joint region, thereby contributing to the correct functioning of the joint region.

Said cylinder cover comprises an essentially rigid block 1 having a substantially square or circular perimeter.

Block 1 has a sealing contour 11 defined in accordance with the format of the head/compression chamber of alternative compressor (not shown) and fixation orifices 12 usually intended for bolts (or the like) employed for securing block 1 to the head/compression chamber of alternative compressor (not shown).

In this sense, and hitherto, such features are common to cylinder covers of the state of the art.

Said block 1 further comprises two support extensions 2 defined from specific portions of the sealing contour 11. Using such support extensions is also common to cylinder covers of the state of the art.

The great differential of the present invention resides in the fact that block 1 further provides at least one support projection spaced from the sealing contour 11 through at least one gap 4.

Figure 2:
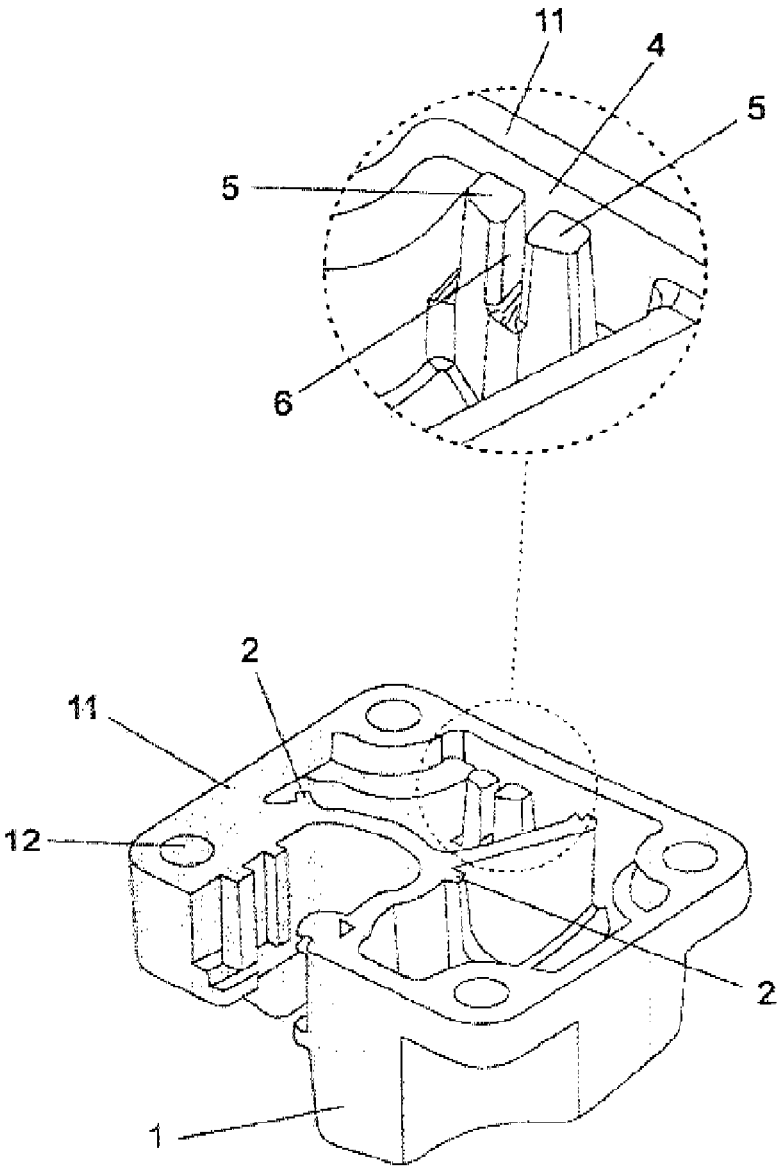
FIG. 2 depicts a preferred embodiment of a cylinder cover in accordance with the present invention.

According to a preferred embodiment of the present invention—illustrated in FIG. 2—said block 1 comprises two support projections 5 spaced from sealing contour 11 through one gap 4, and spaced from one another through another gap 6. As can be noted, said support projections 5 end up defining two top columns preferably flat and suitable for support/housing of an edge of an exhaustion valve stopper.

Preferably, said support projections 5 are vertically designed from lower plate of block 1.

Figure 4:
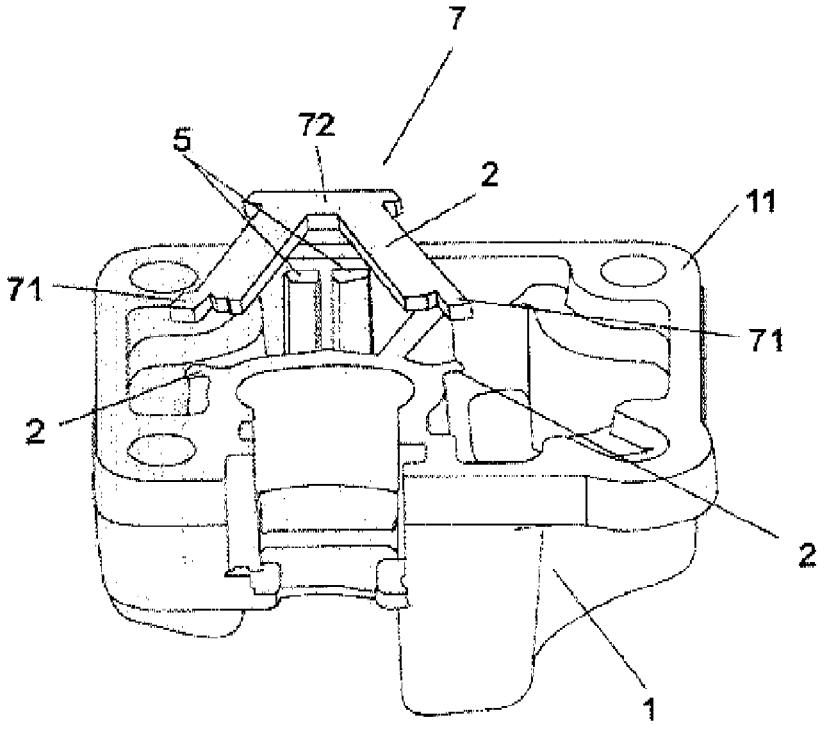
FIG. 4 depicts an example of a stopper support housing of an exhaustion valve in the preferred embodiment of a cylinder cover in accordance with the present invention.

More specifically, and as illustrated in FIG. 4, a V-shaped stopper 7 can have its distal edges 71 conventionally supported on support extensions of block 1, and its edge 72 supported on support projections 5.

The embodiment of block 1, as well as the consequent assemblage of stopper 7, is responsible for "generating" members (support projections 5) having less rigidity for securing stopper 7. In this regard, it can be observed that said support projections 5 respond with elastic deformation to the force exerted by the assemblage of stopper 7 and other components constituting the valve assembly (not shown) disposed at the head of an alternative compressor. In addition, said support projections 5, just because they are "separated" from the sealing contour 11 through gap 4 significantly reduce transmission of stress to other joint regions, said regions being subjected to a lower negligible physical deformation.

Figure 1D:
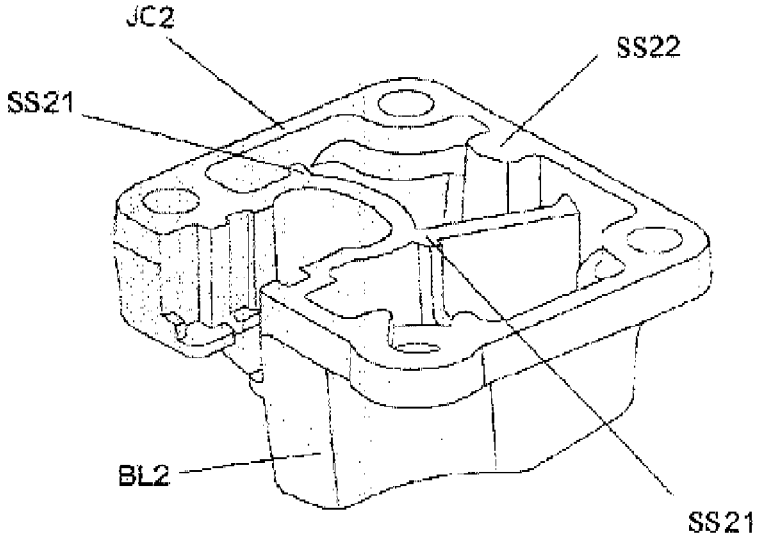
FIG. 1D PRIOR ART

Efficiency of this solution is very clear through the results of cylinder cover structural deformation. Therefore, it is important to mention that laboratory tests demonstrate that the preferred embodiment of the present invention leads to a 66% deformation reduction compared to conventional embodiments (especially compared to the embodiment illustrated in FIG. 1D).

Figure 3:
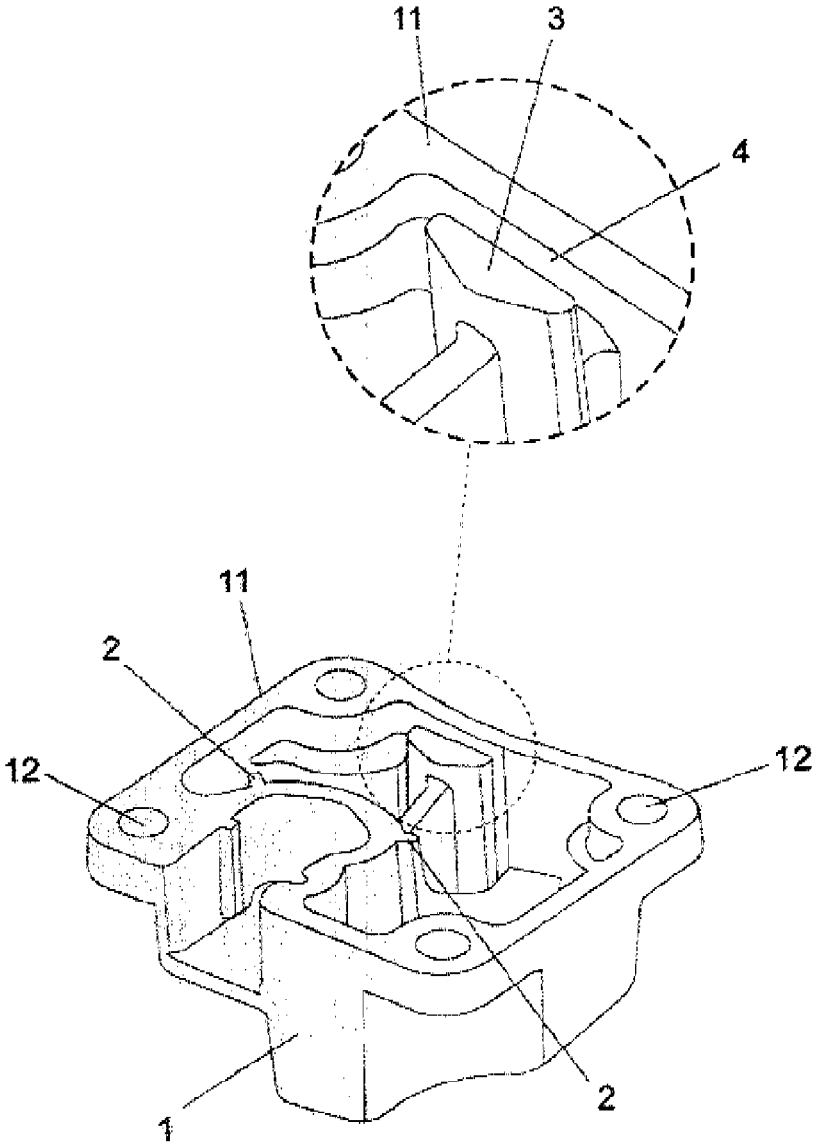
FIG. 3 depicts an optional embodiment of a cylinder cover in accordance with the present invention.

The present invention further provides an optional embodiment of a cylinder cover, as illustrated in FIG. 3.

Such optional embodiment is extremely similar to the preferred embodiment, that is, the cover of the optical embodiment is also constituted by block 1 provided with a sealing contour 11 fixation orifices 12 and two support extensions 2 defined from the specification portion of said sealing contour 11.

Nevertheless, a huge difference between said two embodiments resides in the fact that the present optional embodiment provides only one support projection 7 disposed in the place of the support projections 5. Said support projection 3 is also spaced from the sealing contour 11 through one gap 4.

Moreover, said support projection 3 defines an area surface similar to the virtual area formed by summing up the surface areas of the support projection 5 and gap 6.

Hence, the optional embodiment of the cylinder cover is also capable of supporting a stopper 7.

Further, it necessary to mention that although there have been illustrated embodiments in which only one support projection is spaced from the sealing contour through at least one gap, the scope of the present invention should not be limited to this amount, and, therefore, the present invention also contemplates using multiple projections spaced from the sealing contour by means of respective gaps.

After describing the embodiments of the present invention, it should be understood that the scope thereof contemplates other possible variations, and it is only limited by the content of the set of claims, including possible equivalent means.

The invention claimed is:

1. A cylinder cover for a compressor, comprising:

a block provided with a sealing contour;

at least one support extension defined in the sealing contour;

at least one support projection with at least a portion of the at least one support projection spaced from all sides of an inner perimeter of the sealing contour through at least one gap, wherein the at least one support projection is vertically parallel to at least a portion of the inner perimeter of the sealing contour;

the at least one support projection extending from a lower plate of the block;

the at least one support projection supporting a valve stopper;

the at least one support projection possessing mechanical resilience;

wherein the at least one support projection, during maximum mechanical deformation of the at least one support projection, remains spaced from the sealing contour through the at least one gap;

wherein the at least one support projection is contained between one side of the inner perimeter of the sealing contour and the at least one support extension defined in the sealing contour;

wherein the at least one support projection defines at least one flat top column supporting an edge of the valve stopper, wherein the valve stopper includes a V-shaped plate including two integrated legs connected at a vertex of the V-shaped plate; and wherein the at least one support projection extends to a same level as the sealing contour.

2. The cylinder cover, according to claim 1, wherein the at least one support projection includes two support projections spaced from all sides of the inner perimeter of the sealing contour through the at least one gap and spaced from each other through another gap.

3. The cylinder cover, according to claim 1, wherein the separation of the at least one support projection from the sealing contour through the at least one gap reduces the transmission of stress to other joint regions, the other joint regions being subjected to a lower physical deformation.

* * * * *